US005474117A

United States Patent [19]

Henkenjohann

[11] Patent Number: 5,474,117

[45] Date of Patent: Dec. 12, 1995

[54] LOCKING MECHANISM FOR A ROLL-UP CLOSURE

[76] Inventor: Johann Henkenjohann, Oesterwieher Strasse 80, D-33415 Verl, Germany

[21] Appl. No.: 319,783

[22] Filed: Oct. 7, 1994

[30] Foreign Application Priority Data

Oct. 14, 1993 [DE] Germany ..... 43 35 032.1

[51] Int. Cl.[6] ..... E06B 9/08

[52] U.S. Cl. ..... 160/133; 160/291

[58] Field of Search ..... 160/133, 291, 160/300, 302, 209, DIG. 15

[56] References Cited

FOREIGN PATENT DOCUMENTS

| | | | |
|---|---|---|---|
| 2312639 | 12/1976 | France | 160/291 |
| 2404301 | 8/1975 | Germany | 160/133 |
| 2521183 | 11/1976 | Germany . | |
| 2644142 | 4/1978 | Germany | 160/133 |
| 2740869 | 3/1979 | Germany | 160/133 |
| 2743736 | 4/1979 | Germany | 160/133 |
| 3019566 | 1/1990 | Germany . | |

*Primary Examiner*—Blair M. Johnson

*Attorney, Agent, or Firm*—Burns, Doane, Swecker & Mathis

[57] ABSTRACT

A roll-up closure such as a blind or door comprises vertically adjacent, horizontal slats that can be rolled up on a rod. A lowermost slat carries pins that are spring-biased outwardly into locking recesses to resist unintentional lifting of the lowermost slat. The pins are automatically retracted in response to rotation of the rod for raising the closure. An uppermost slat carries a security finger which projects beyond one end thereof and engages the underside of a stop to prevent the uppermost slat from being unintentionally lifted. A cam carried by the rod prevents the pin from moving out from beneath the stop. When the rod is rotated in a closure-raising direction the cam is shifted in a manner permitting the security finger to be disengaged from the stop.

13 Claims, 4 Drawing Sheets

Fig. 4a
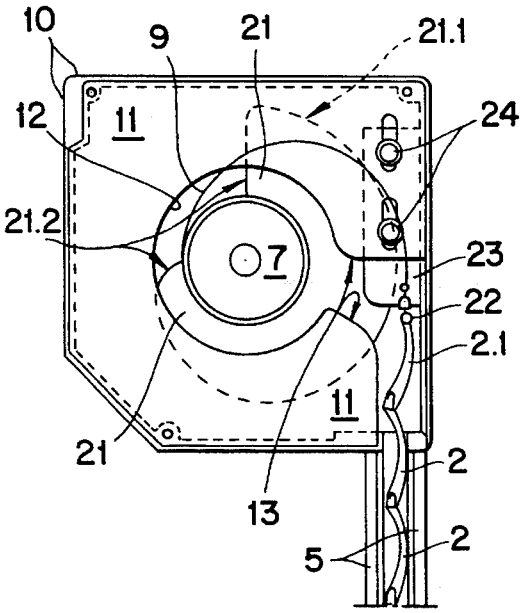
Fig. 4b
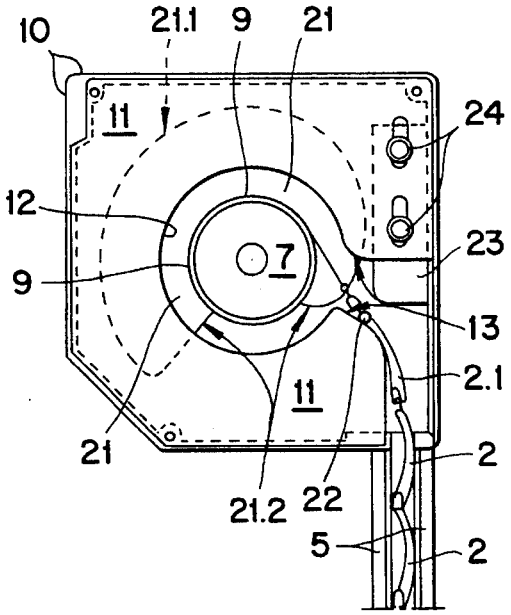
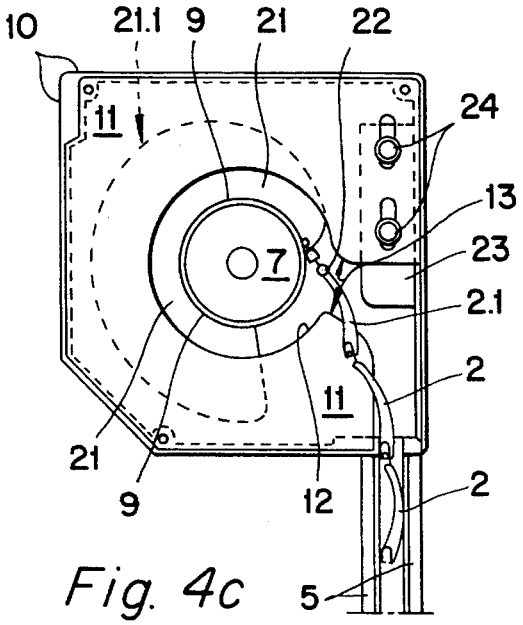
Fig. 4c
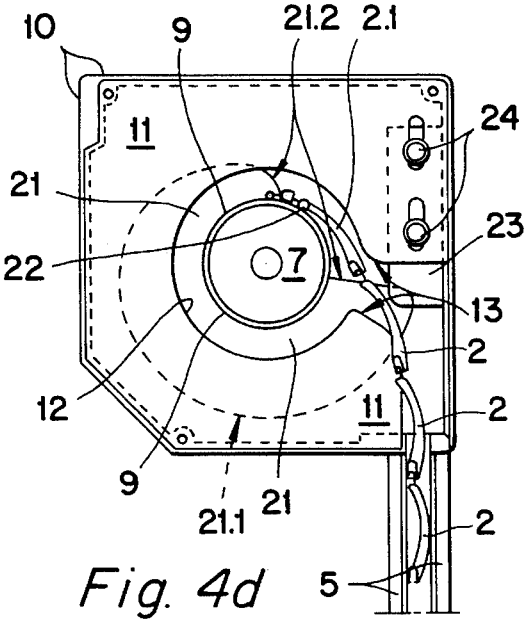
Fig. 4d

LOCKING MECHANISM FOR A ROLL-UP CLOSURE

FIELD OF THE INVENTION

The invention relates to a security device for a roll-up closure such as a blind or roll-up door. More particularly, this invention relates to such a device for use with a closure which is assembled from slats and is capable of being rolled up and let down from a rod, and where the last slat of the roll-up blind or roll-up door is provided with at least one securing pin which is outwardly slidable for securing the closure to a frame.

BACKGROUND OF THE INVENTION

Roll-up closures such as blinds or roll-up doors are known in the art; they use outwardly-slidable securing pins to prevent the closure from being opened by unauthorized persons. For this purpose, and as disclosed in DE-PS 30 19 566 or DE-OS 25 21 183, an arrangement is taught where the lowest slat is provided with at least one securing pin that is slidable sideways. The pin works together with a spring whose normal bias forces the pin to slide out of an existing pin recess. When the roll-up blind or roll-up door is in a closed state, there is no pulling force to act against the tension of the spring. A pulling force is generated by means of a cable that connects the uppermost slat to the securing pin. In such an arrangement, use is made of the fact that during opening, the slats of a roll-up blind are maintained at a distance from one another, as opposed to the position of the slats when the roll-up blind is being closed. During opening, the creation of distances between the slats results in the cable being tensioned, thereby transmitting a pulling force to the securing pin. Thus, during opening (and also during closing), the securing pin is retracted by means of the pull cable. In fully closed position, the pull cable is in a relaxed condition and the pin is slid outwardly by the force of the spring and into a lateral recesses of a surrounding frame. If, during a break-in attempt, the uppermost slat is lifted up, the slats will be separated from one another, which will thus cause the pull cable to become taut, which will cause the securing pins to retract, the result of which being that the roll-up blind, or the roll-up door, can be unlocked.

An object of this invention, therefore, is the development of a roll-up closure security system for the purpose of eliminating the possibility of forced entry. With this invention, not only can this be accomplished by inexpensive means, but the securing device can also be simply installed.

SUMMARY OF THE PREFERRED EMBODIMENT OF THE INVENTION

One object of this invention is to provide a security device for a roll-up blind or a roll-up door comprised of slats which can be rolled up and let down upon a rod, wherein a lowermost slat is provided with at least one slidable securing pin, the improvement wherein the rod includes a locking mechanism comprising a cam arranged on at least one side of the rods, and cooperating security finger means cooperative with a cam and projecting at one side, thereof, the security finger means being provided on an uppermost slat near the rod; the locking mechanism including catch means fixedly securable to a frame member to block the security finger means when the roll-up blind or door is closed, the cam including a recess extending to about the circumference of the rod, and an uppermost slat of the roll-up blind or door being attached to the rod, whereby the security finger means is guided into the recess of the cam and retained therein when the roll-up blind is pulled up.

Advantageously, according to this invention, a rod of the above type features a locking mechanism comprising a cam that is arranged on one side of the rod and a security finger, which, being arranged on one side along the uppermost slat nearest the rod, interacts which the cam, as well as with a locking catch. The latter is fixed to a frame of the opening, so as to arrest or stop the security finger when the roll-up blind is closed. In this arrangement, the cam features a recess that extends to the circumference of the rod, and the uppermost slat of the roll-up blind is secured to the rod in such a way that the security finger of the latter is, during opening of the roll-up blind, slidable received by and held inside the recess of the cam.

An important element in the arrangement is that the catch, by an arresting cooperation function with the security finger, will prevent the uppermost slat of the roll-up blind from being forced upwards. This prevents the withdrawal of any securing pins that could be retracted by means of pull cables, a movement which can only occur if the pull cables are pulled taut by the separation of at least the lower slats of a roll-up blind when one of the upper or uppermost slats moves upwardly so as to cause the securing pins to be pulled back. The security finger, which projects far enough to be positioned over the cam, is guided by the latter in such a way that when the roll-up blind, or roll-up door is closed, the security finger is released upon the final rotation of the rod and will come to rest on top of the cam in its position beneath the catch. When the roll-up blind or roll-up door is opened, the rod attached, to the uppermost slat, is set into motion and the slat is pulled by the catch radially toward the inside (relative to the rod) so that it slides over the curve into the recess. This permits the uppermost slat to come to a rest position on the surface of the rod, and the following slats to be rolled up without interference. The catch, against which the security finger rests, can, in this arrangement, be any one of a number of suitable elements fitted into an opening of the masonry or, alternatively, to the door or window frame. In such an arrangement, the security finger is embodied in the form of a pin fitted into the uppermost slat of a roll-up blind and which projects in a longitudinal direction beyond such a slat.

The cam can be provided with brake or stop means to stop the movement of the roll-up rod with the attached cam at a point that is optimal for the securing operation. These stop means can, for example, be a permanent magnet arranged in this optimal position and which, when an optimal point is reached, interacts with the security finger. In such an arrangement, the magnet may comprises a ferromagnetic material, which advantageously also uses a piece of magnetized, flat steel inserted into the uppermost slat.

In order to secure the uppermost slat, an further advantageous embodiment of the invention involves the provision on the rod of at least two flexible connecting elements, whose length is designed to accommodate the diameter of the rod, so that, when the roll-up blind is rolled up, the security finger will be pulled into the recess of the cam. In this arrangement, the angle of contact, which the connectors form when the rod is wound up, is such that the length of roll-up corresponds to the angle moved through by the curve of the cam. Such a matching of the length ensures that the security finger will, during opening, slide directly into a position beneath the catch, and directly into the recess in the cam to permits the uppermost slat to come to rest on the surface of the rod. Continuous roll-blind belts, or band-springs, can be used as a binding means so that the uppermost slat can be connected to the roll-up rod. In this embodiment, the use of a non-rusting steel will ensure extended life for such band springs.

It is advantageous if a stop plate is provided as the catch in the region of the rod bearing that is designed for use in conjunction with the security finger. It should preferably be arranged in such a way that its height is adjustable. In this arrangement, the height-adjustment region of the stop plate should be at least one-half the width of a slat of a roll-up blind or a roll-up door. Although the size of the porter opening for the roll-up blind or roll-up door can allow for a calculation of the number of slats required, consideration of the fact that the port was not normally designed to take into account the dimension and numbers of the slats, would dictate that it is preferable if the exact position of the catch can be adjusted to allow the security finger to be guided by the cam to a position beneath the catch, when the lowest of the slats has come to a rest on top of the window sill or the door base and when any ventilation slits have been closed. This can be achieved is permitted by the adjustability of the height of the catch, so that it is sufficient, in general, if an adjustment is made through a range of one-half of the width of a slat, and so that the area of adjustability does not have to exceed the width of a slat.

If roll-up blinds are to be installed in new construction, the stop plates can be successfully used when installed on the front end wall of the roll-up blind or roll-up door frame with a capability of being adjusted, so that the surface of the lower edge of the stop plate forms the catch. In retrofit applications, the front wall of the frame is provided with a strip-shaped element oriented in the direction of the footing and, as a replacement for the adjustable stopping plate, forms the security stop. The length of the strip-shaped projection can be selected to exceed the expected projection length, which permits it to be cut to a length required for secure locking. This arrangement also facilitates adjustment in the case of a retrofit installation, since the screws, which hold the stop plate in position, can be accessed from the side, which is not always possible in the case of retrofits; in the front wall embodiment described above, the projection can very easily be cut to length from the front, for example, by means of tin shears, which eliminates the need for access from the side.

A roll-up blind securing system secures roll-up blinds or roll-up doors, even when the latter can be locked by means of an additional locking system operating with laterally-acting securing pins. If such securing pins (or levers or flanges or similar elements that can be swung outwardly) are provided, the effectiveness of these securing means is augmented, and thus entirely precludes the possibility of forced entry. For this purpose, it is particularly advantageous if the cam be fitted with a peg-like projection, which, in order to prevent undesired rotation, preferably fits into the rod for the roll-up blind or the roll-up door. The projection may be embodied as, eg., a hollow rod. This peg-like extension or projection also permits adjustment of the cam along the axial direction of the rod, and it will, of course, be appreciated that following insertion, and if required adjustment, the fitted projection in the rod can be held in position by for example means of a screw.

BRIEF DESCRIPTION OF THE DRAWINGS

Having thus generally described the invention, reference will now be made to the accompanying drawings, illustrating preferred embodiments.

FIGS. 4*a* through 4*d* illustrate the sequence of interaction of the cam with the security finger as the blind is being rolled-up.

DETAILED DESCRIPTION OF THE PREFERRED EMBODIMENTS OF THE INVENTION

Figure 1:
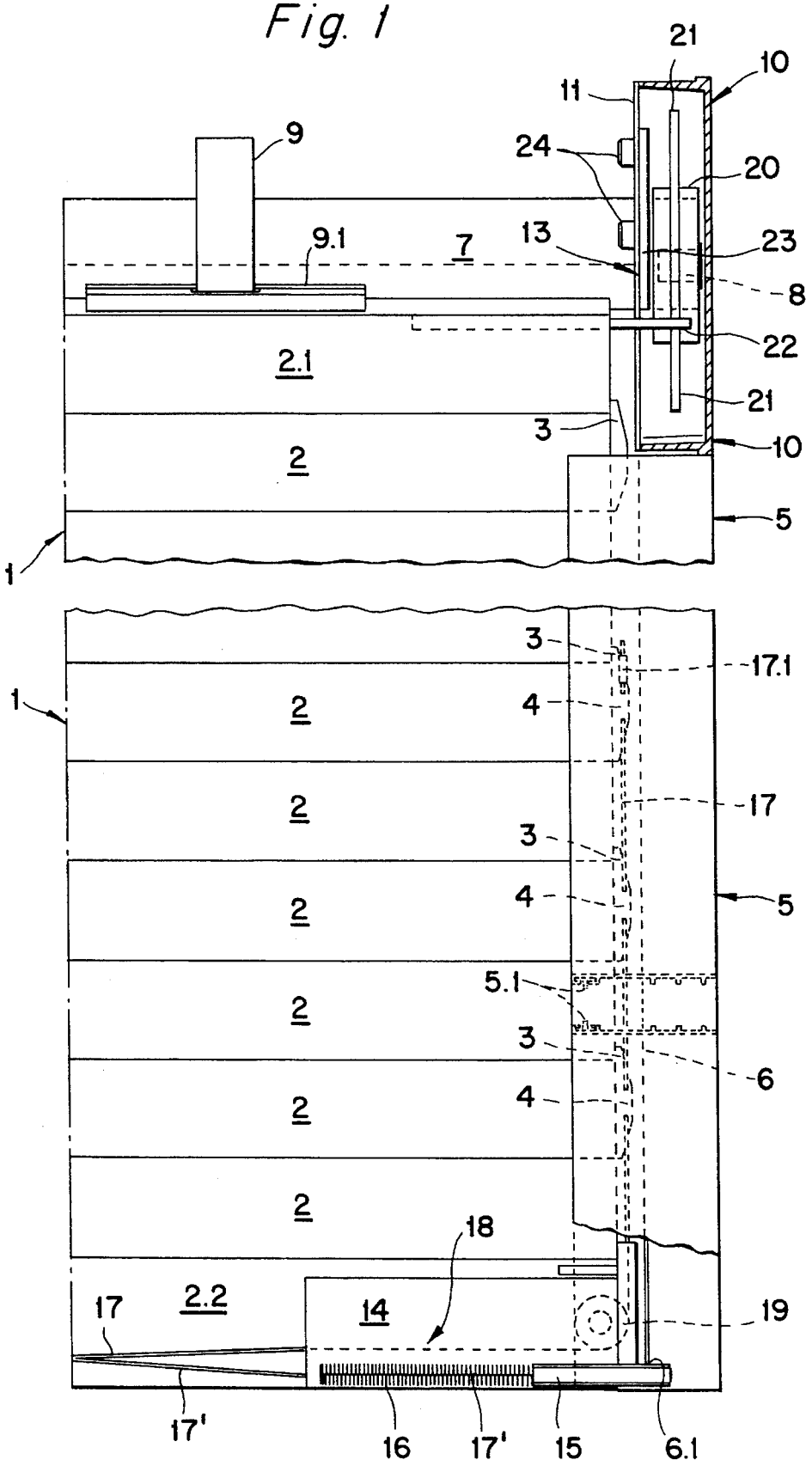
FIG. 1 is a front view of a right-half of a roll-up blind (partially-cut away), with a securing pin and a security finger.
Figure 2:
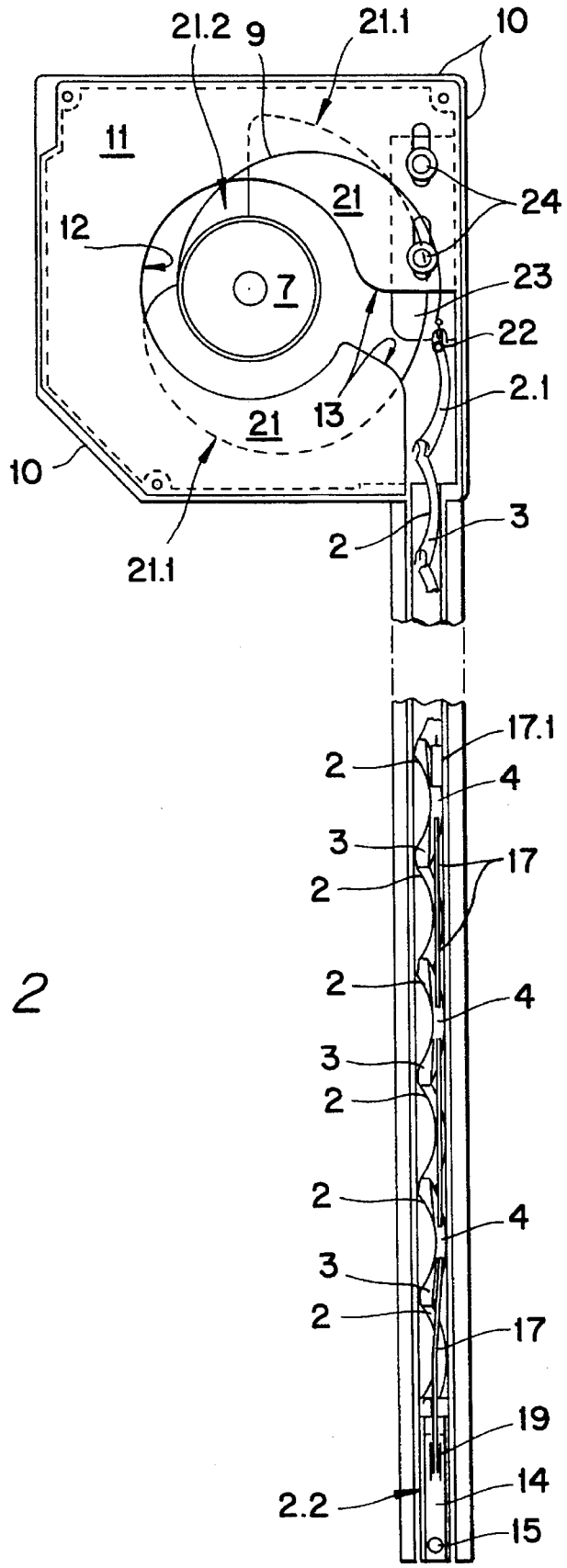
FIG. 2 is a side view of the roll-up blind in a lowered (closed) state.

FIGS. 1 and 2 show a roll-up closure in the form of a blind 1, which, with its slats 2, joined to one another, closes off a window opening (or a door opening). The roll-up blind can be rolled up upon the rod 7 by suitable means (e.g., a conventional manual or electric drive system which need not be shown in greater detail). The edge sections of slats 2 slide within lateral guides 5 of a frame, which, as a rule, are cemented or held into adjacent masonry and which include longitudinally-extending sealing strips 5.1 functioning to suppress rattles when the roll-up blind moves. Rod 7 is, for the purpose of rolling up the blind, rotated by means of the drive system, for which purpose the ends of the rod are (together with bearing neck 8) housed for rotation inside a bearing casing 10. The latter, as a rule, is located in adjacent masonry and sealed with a cover 11.

The uppermost slat 2.1 is connected to rod 7 through a band spring 9 which, for example, is attached to the upper slat by means of a clip 9.1. The result is that the uppermost slat 2.1, together with the following slats 2, can be rolled up on rod 7 when the roll up blind is opened. In order to facilitate sliding of the slats, at least two of the slats 2 are provided with end stops, which are accommodated in the grooves of the lateral guide profiles 5. The roll-up action can now be achieved when the bottom slat, which is embodied as a close-off strip 2.2, is lifted. In order to prevent an unintended roll-up action, a security insert 14 is attached to the close-off strip and carries a securing pin 15 which is slidable perpendicularly (i.e., horizontally) relative to the vertical direction of movement of the roll-up blind. This security pin 15 is located inside a guide extending in the longitudinal (i.e., horizontal) direction of the close-off strip 2.2 and is provided with a compression spring 16 so that when the roll-up blind is in a closed state, the spring will force the pin into locking engagement with a recess 6.1. Recess 6.1 is provided in a medial web 6 of the lateral guide profiles 5 to eliminate the possibility of the roll-up blind opening under upward pressure. An identical securing pin is provided on the opposite side (left side) of the close-off strip 2.2 for engagement with a recess.

In order to be able to open the roll-up blind 1 by means of rod 7, a cable arrangement 17, 17' is provided which automatically pulls the two pins 15 out of their respective recesses 6.1 as the blind begins to be raised. The cable arrangement comprises two identical cables 17 and 17'. The cable 17 is connected to the left-side pin (not shown), whereas the cable 17' is connected to the depicted right-side pin 15. The actuating mechanism for the cable 17 is depicted, but the identical actuating mechanism for the cable 17' is not depicted. Therefore, only the cable 17 will be hereinafter described in detail. The cable 17 is connected to selected slats 2 so that end stops 3 of some of those selected slats possess appropriately-shaped pull cable guides 4 through which the pull cable 17 is guided. When the roll-up blind is opened, the slats 2 are lifted up, thus increasing the spacing between the slats. This is most particularly the case whenever slats 2 feature aeration slits (not shown in greater detail).

Such an increase in the slat spacing causes the pull cable 17 to be tensioned, because an upper free end of the cable is affixed to one of slats 2 by means of a protective bushing 17.1. This tension is transferred to the left side pin (not shown) simultaneously as the pull imposed on the cable 17' is applied to the right-side pin 15. Hence, both pins 15 are retracted, whereupon the roll-up blind is released (unlocked). The number of slats 2 which are to carry guides 4 in this arrangement is determined by the length of the cable required to withdraw the securing pin 15, as well as the required increase in spacing between two adjacent slats 2. It will be appreciated that a securing pin 15 can be arranged on one side only of the blind, rather than on both sides. Accordingly, only one cable 17 or 17' would be provided.

Since the securing pins 15 are retracted in response to the upper slats being manually lifted up, a further security arrangement is provided in accordance with the invention for the purpose of eliminating this unwanted opening in the absence of rotation of the rod 7, and which additional security system is integrated with bearing casing 10. Cover 11 of bearing casing 10 includes an opening for rod 7 and is provided with a recess 13 that opens downwardly towards the lateral guide profile 5 to permit insertion of a security finger 22. The latter projects horizontally outwardly from the uppermost slat 2.1.

Security finger 22, designed so as to be able to slide along a continuously-rising curve 21.1 of a cam 21 arranged on rod 7, is forced by such cam to move out to a position beneath a stopping plate 23 functioning as a catch when the blind is closed (see FIG. 2). That catch prevents the blind from being manually pushed up with the aim of pulling back the securing pin or pins 15.

Figure 3:
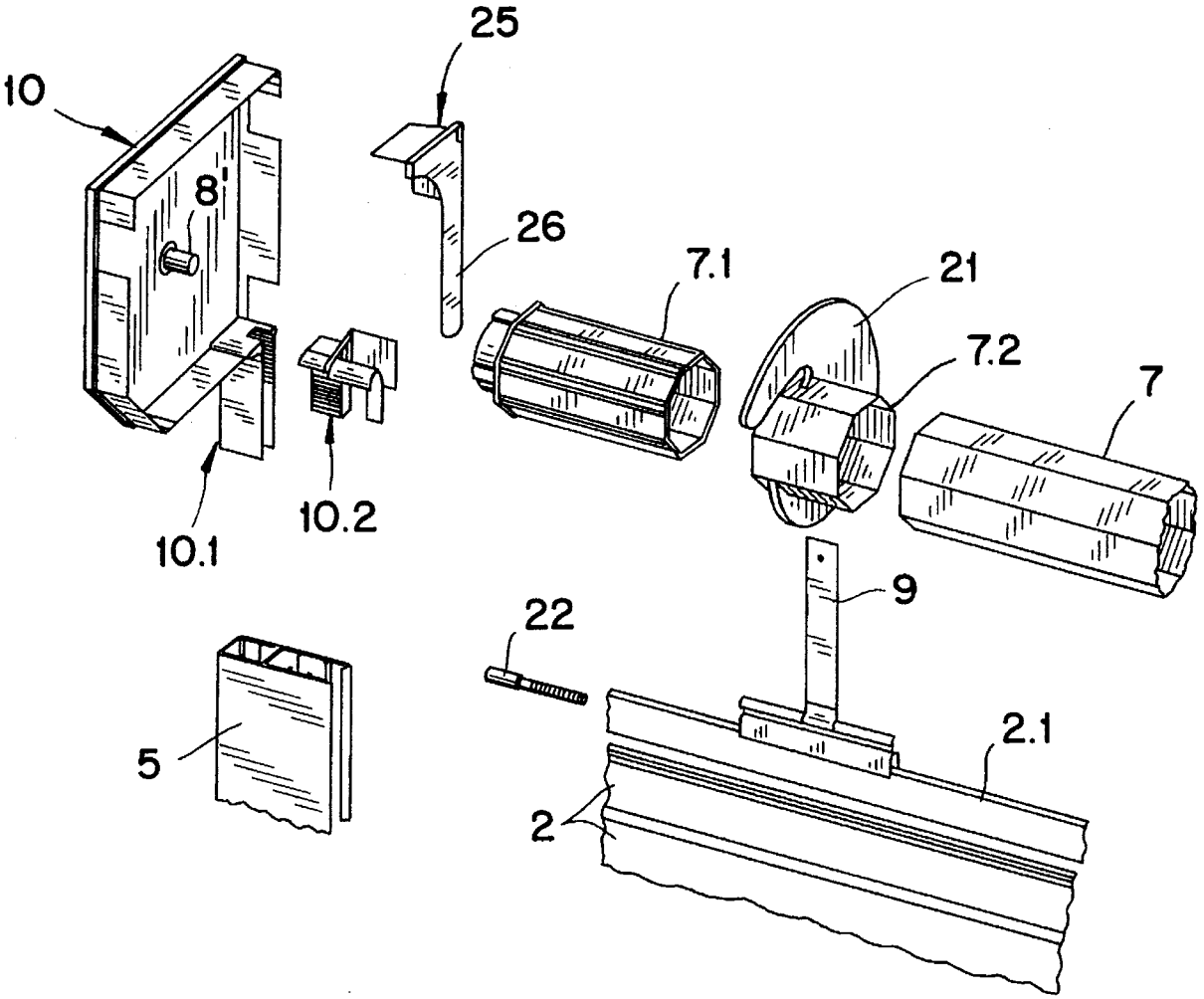
FIG. 3 is an exploded view of an end of the rod, together with a bearing casing and entry.

FIG. 3 shows a bearing neck 8' provided on the outer wall of bearing casing 10, and to which a rod section 7.1, which snugly receives the end of rod 7, is rotatably mounted. Attached to the entrance 10.1 of the bearing casing is the uppermost lateral guide profile 5, by means of an insert 10.2 which ensures a smooth transfer of the slats of roll-up blind 1. The slats 2 of roll-up blind 1 are attached to rod 7 via band spring 9; this arrangement permits the slats to be rolled up when rod 7 is rotated. The security finger 22 is positioned beneath the stopping plate 23 when the blind is in a closed state, and the cam prevents the security finger from deflecting or bending towards the axis of the rod, i.e., from traveling out from under the plate 23.

The cam is snugly or tightly fitted by means of a bushing 7.2 onto rod 7. Cam 21 is thus permitted to sit on rod 7 at an angle determined by the polygonal shape of rod 7, arrangement that facilitates adjustment of the cam. Cam 21, shown in this example, features a sickle-like finger 21.1 which is located in the area of the large diameter of the cam. The finger serves as an extension of the curve which rises (i.e., increases in radius) continuously in the direction of closing the closure. A space is provided underneath the sickle-like finger, in which space the security finger 22 can fit in the event of tight winding. In lieu of an adjustable plate 23 the travel path of security finger 22 can be blocked by a stop in the form of a long projecting shank 26 of an insert 25. Insert 25 can be inserted into bearing casing 11 or can be attached to the casing cover cut to length at a construction site in accordance with local requirements. This arrangement permits the insert 25, in conjunction with security finger 22, to ensure the desired or necessary locking position of the blind. The insert 25 also permits, similar to the adjustable plate 23 disclosed in FIGS. 1, 2, a post-installation adjustment, if this should ever prove necessary in the future.

FIGS. 4*a* to 4*d* show the sequential steps of a roll-up procedure in four selected positions. The stop plate for the pin 22 is the adjustable plate 23 of FIGS. 1, 2. FIG. 4*a* illustrates the blind in a rolled down and fully closed position. The slats 2 have run along lateral guide profiles 5 and the uppermost slat 2.1 is shown above the entry area, i.e., above the uppermost guide profile 5. In this state of the closure, the security finger 22 is disposed directly below stop plate 23. Due to the adjustability of the height of the plate 23, it can be adjusted so that security finger 22 can rest directly against the lower edge of stop plate 23 without being pressed against it.

Cover 11, which fits on top of bearing casing 10, features an opening for the passage of rod 7, onto which the slats 2 of roll-up blind 1 are to be rolled. Cover 11 also includes a recess 13 that communicates the opening 12 to the outside (not shown in detail) and forms a passage for security finger 22. The latter is thus enabled, when the blind is being rolled down, to move towards the outside toward the catch 23, and during roll-up, to return inwardly towards the rod 7. Should an attempt be made to open the roll-up blind in this position by pushing upwardly on the blind from below the rod 7, the security finger will be pressed against the lower edge of stop plate 23, and thus the roll-up blind 1 will be locked against any further opening movement. The security finger 22 is prevented from slipping out of its position by the cam 21 which blocks the travel of security finger 22 through recess 13 and into cover 11 of bearing casing 10.

FIGS. 4*b* to 4*d* show, in stepwise fashion, the procedure for opening the roll-up blind, roll-up gate or roll-up door. FIG. 4*b* shows a position in which the roll-up rod has been rotated so that the cam 21 no longer blocks passage 13; additionally, the band spring 9 is fully taut and has pulled the security finger 22 away from the stop plate 23, and thus through the now-unblocked recess 13 into the cover 11 of the bearing casing. If the roll-up blind is rolled up further, security finger 22 moves into recess 21.2 of cam 21, located on rod 7, and is followed, (as is shown in FIGS. 4*c* and 4*d*), by the uppermost slat 2.1, as well as by further slats 2. Due to the narrow width of slats 2, they are capable of being pulled between the covers 11 of both of the opposite bearing casings 10. The roll-up blind can now be pulled up, without any interference, far enough so that the securing pin or pins 15 can be unlocked. After unlocked, the roll-up blind 1 can be rolled up in the normal fashion, in which case the "rolled-in" security finger 22 remains in the region of the opening 12 of the cover 11 of the bearing casing 10.

The closing of blind 1 occurs in the reverse sequence. The uppermost slat 2.1, together with its security finger 22, travels into the entry region of the guide profiles 5. Once again, cam 21, together with rod 7, when rotated further, closes off recess 13 inside cover 11, and permits security finger 22 to travel beneath stopping plate 23 and be held in that position.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A roll-up closure assembly, comprising:

a horizontal rod rotatable about a horizontal axis, a stationary stop surface arranged adjacent said rod, and a closure member comprising:

a plurality of vertically adjacent, horizontally extending slats, an uppermost one of said slats connected to said rod to enable said closure to be wound upon said rod in response to rotation of said rod in a closure-opening direction, a security finger projecting from said uppermost slat and arranged to lie beneath said stop surface when said closure is in a fully closed state, to prevent said closure from being moved upwardly independently of rotation of said rod, and a cam mounted on said rod and arranged to position said security finger beneath said stop surface when said closure is in a fully closed state, said cam being rotatable with said rod such that rotation of said rod in a closure-opening direction enables said security finger to be pulled from beneath said stop surface.

2. The roll-up closure assembly according to claim 1, wherein said closure member further includes a securing pin slidably mounted on a lowermost one of said slats and being spring biased into engagement with a stationary locking means.

3. The roll-up closure assembly according to claim 2 including a cable attached to at least some of said slats and said securing pin for retracting said pin from said locking recess in response to rotation of said rod in a closure-raising direction.

4. The roll-up closure assembly according to claim 1, wherein said cam is mounted on said rod by a friction fit.

5. The roll-up closure assembly according to claim 1, wherein said security finger projects horizontally from one end of said uppermost slat.

6. The roll-up closure assembly according to claim 1, further including a connection member connecting said uppermost slat to said rod, said cam comprising a spiral surface which gradually moves away from said stop surface in response to rotation of said rod in a closure-opening direction, said connection member arranged to pull said uppermost slat toward said rod at a rate coinciding with a rate at which said cam surface moves away from said catch.

7. The roll-up closure assembly according to claim 6, wherein said connection member comprises band springs.

8. The roll-up closure assembly according to claim 7, wherein said band springs are formed of rust-proof steel.

9. The roll-up closure assembly according to claim 1, further including a bearing to which said rod is rotatably mounted, said stop surface comprising a catch mounted adjacent said bearing.

10. The roll-up closure assembly according to claim 9 further including a casing on which said bearing is mounted, said catch being vertically adjustably mounted on said casing.

11. The roll-up closure assembly according to claim 10, wherein said casing includes slots, said catch carrying screws mounted for vertical sliding movement in said slots.

12. The roll-up closure assembly according to claim 9, wherein said catch comprises a strip-shaped extension of an insert mountable to said casing and which can be cut to a desired height.

13. The roll-up closure assembly according to claim 10, wherein the amount of vertical adjustment of said catch is equal to at least one-half of a vertical width of said slat.

* * * * *